United States Patent [19]

Godderidge

[11] Patent Number: 4,700,766

[45] Date of Patent: Oct. 20, 1987

[54] PROCESS AND APPARATUS FOR RECLAIMING FOUNDRY SCRAP SANDS

[75] Inventor: Volker Godderidge, Irdning, Austria

[73] Assignee: GSR Sandregenerierungsgesellschaft mbH, Irdning, Austria

[21] Appl. No.: 734,744

[22] Filed: May 15, 1985

[30] Foreign Application Priority Data

Jan. 10, 1985 [EP] European Pat. Off. ..... 85890004.6

[51] Int. Cl.[4] ..... B22C 5/18

[52] U.S. Cl. ..... 164/5; 164/412; 241/DIG. 10

[58] Field of Search ..... 164/5, 412; 241/DIG. 10, 65, 23

[56] References Cited

U.S. PATENT DOCUMENTS 4,508,277 4/1985 Andrews ..... 164/5

FOREIGN PATENT DOCUMENTS 1146226 10/1963 Fed. Rep. of Germany .
1433941 11/1968 Fed. Rep. of Germany ..... 164/5
2307773 8/1973 Fed. Rep. of Germany ..... 164/5
2233923 1/1974 Fed. Rep. of Germany .
2252217 5/1974 Fed. Rep. of Germany .
2252259 5/1974 Fed. Rep. of Germany .
2432853 1/1975 Fed. Rep. of Germany ..... 164/5
2435943 2/1975 Fed. Rep. of Germany .
2408981 9/1975 Fed. Rep. of Germany ..... 164/5
2508630 9/1975 Fed. Rep. of Germany ..... 164/5
2429169 1/1976 Fed. Rep. of Germany .
2537259 3/1976 Fed. Rep. of Germany .
2445439 4/1976 Fed. Rep. of Germany .
2451494 5/1976 Fed. Rep. of Germany ..... 164/5
2623882 12/1976 Fed. Rep. of Germany .
2909408 10/1979 Fed. Rep. of Germany .
3400648 7/1985 Fed. Rep. of Germany ..... 164/5
3690 2/1976 Japan ..... 164/5
25243 2/1982 Japan ..... 164/5
560081 3/1975 Switzerland .

OTHER PUBLICATIONS

"Verfahren zur Sändruckgewinnung", Henry W. Zimnawoda, Giesserei, Oct. 5, 1972, pp. 593–606.

*Primary Examiner*—Nicholas P. Godici
*Assistant Examiner*—Samuel M. Heinrich
*Attorney, Agent, or Firm*—Young & Thompson

[57] ABSTRACT

In a process for reclaiming foundry scrap sand, containing organic and inorganic binders, the comminuted foundry sand is precleaned in a dry state by allowing it to impinge and/or by grain-against-grain friction, is regenerated by thermal treatment, and is subsequently subjected to a final cleaning in the dry state, separated slurry materials being separated from the regenerate by a gas stream. An apparatus for conducting the process comprises a rotary drum (5, 46, 107) and/or a shotblasting cleaner (102) for precleaning, a fluidized-bed furnace (9, 51, 108) for thermal regeneration, and a further rotary drum (10, 59, 109) and/or a further shotblasting cleaner (151) for the final cleaning, and is accommodated in several container-type vessels (I through IX) which latter can be set up in superimposed relationship.

7 Claims, 5 Drawing Figures

PROCESS AND APPARATUS FOR RECLAIMING FOUNDRY SCRAP SANDS

Figure 1:
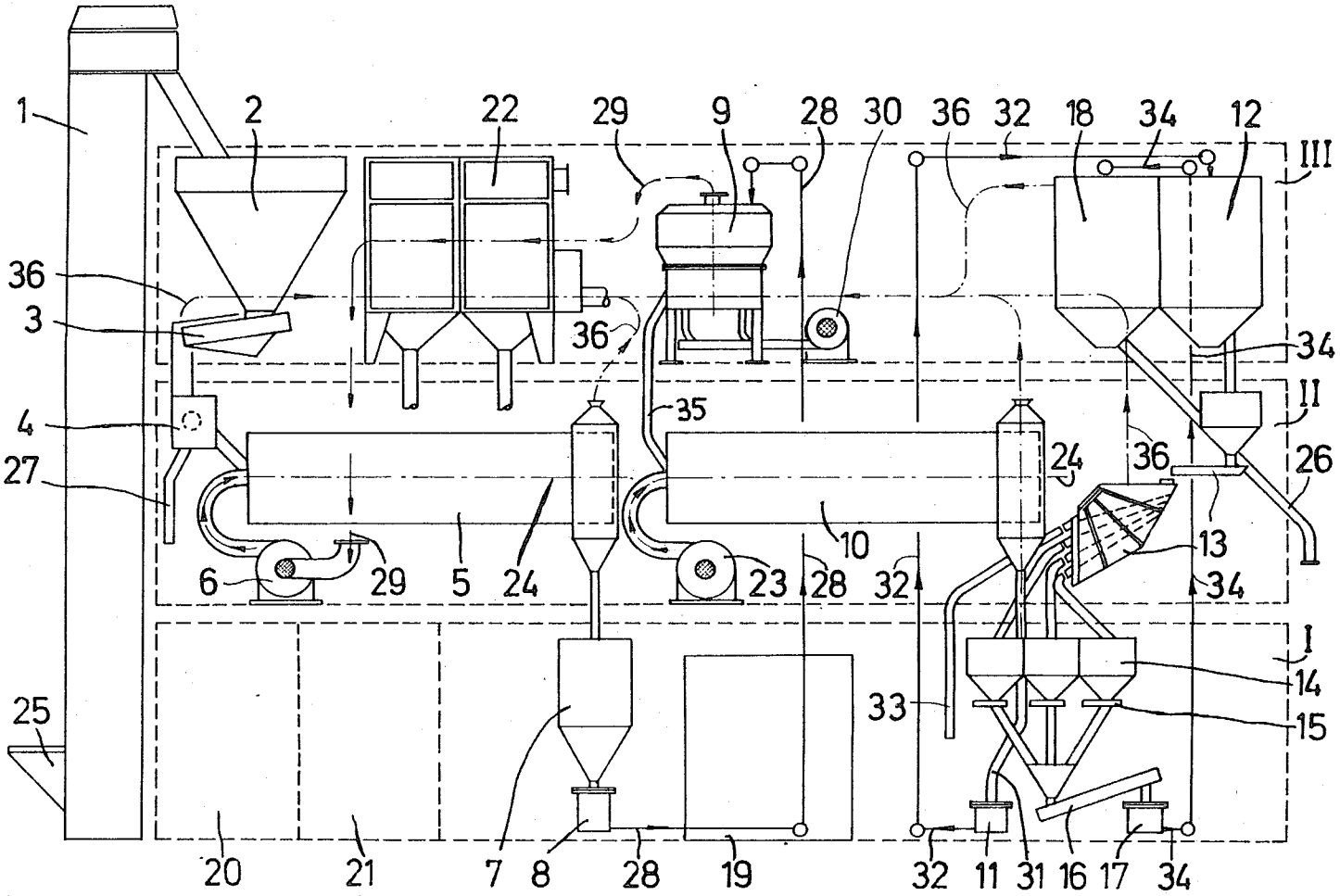

The invention relates to a process for reclaiming foundry scrap sands containing used sand mixtures with organic and inorganic binders, such as active and dead-burned bentonite and synthetic resins and optionally additional slurry materials such as coal dust, polystyrene, fine quartz dust, etc.; in this process, the crushed and optionally screened foundry sand is subjected, for removal of organic binders, to a thermal regeneration by heating and subsequently to a final cleaning wherein binder residues adhering to the sand grains are mechanically removed from the grain surfaces.

The castings manufactured in foundries are produced predominantly in so-called green-sand molds, green sand being understood to mean a quartz sand with inorganic bonding agents, such as, for example, bentonite (clay). The green sand is strengthened mechanically with the addition of water by means of jarring until the required mold hardness has been attained.

For the formation of the internal contours of the casting, core members are inserted in the green-sand molds; these core members are made up of quartz sand with the addition of organic binders, such as furan resins or phenolic resins. The core becomes firm due to chemical curing of the binders.

After solidification of the casting, the latter is separated from the mold. Normally, the core members will disintegrate on account of thermal stress during the casting step whereby a mixture is produced of green sand and core sand ("scrap sand") which, if it is to be reused, must be processed.

It is known to process green sand obtained after the casting procedure by means of a mechanical treatment. For this purpose, the sand is flung at high velocity by means of an air jet against an impact bell, thus blasting bentonite off the quartz grains (German Pat. No. 1,146,226).

It is furthermore conventional to process core sands with organic binders in a thermal treatment. In thermal processing, all organic components of the binders are combusted so that the quartz sand becomes reusable (DOS No. 2,252,217, DOS No. 2,252,259, Swiss Pat. No. 560,081).

Still other reclaiming methods for foundry sands have been described in the article by H. W. Zimnawoda "Verfahren zur Sandrueckgewinnung" [Processes for Sand Recovery] in "Giesserei" [Foundry] 59th year (1972) 20: 593 et seq. Zimnawoda discloses pneumatic reclamation, wet regeneration ("water cleaning") and thermal sand reclamation, but the latter is usable only for exclusively organically bonded foundry sands, since clay-containing binders are sintered onto the sand grains during thermal treatment (annealing) and practically can no longer be removed (cf. H. Jansen "Die Regenerierung von Formstoffen, besonders von kunstharzgebundenen Altsanden" [Regeneration of Mold Materials, Particularly Used Sands Bonded with Synthetic Resins] in "Giesserei" 59th year [1972] 20: 599 et seq., especially page 604, left-hand column; DOS No. 2,909,408, page 6, second paragraph, and DAS No. 2,429,169, column 2, lines 41-45). Furthermore, combination methods are described. H. W. Zimnawoda and H. Jansen point to the possibility of reclaiming foundry sands in two-stage processes wherein the main proportion of clay residues is to be removed by wet regeneration in a first stage for preliminary cleaning and, in a subsequent thermal stage, the organic binder proportions are to be entirely removed by annealing (750°–820° C.) (Zimnawoda, loc. cit., page 597, and Jansen, loc. cit., page 604). However, Zimnawoda points out that wet regeneration ("water purification") is expensive whereas Jansen doubts the practical applicability of the combination reclamation process.

For all of the reasons recited above, reuse of reclaimed used sands is essentially restricted to mold manufacture. New sand must be utilized predominantly for core manufacture in order to ensure the required core strength with the given binder quantities. Heretofore, merely 30–40% of reclaimed used sand could be admixed for core manufacture (cf. H. W. Zimnawoda, loc. cit., page 594, right-hand column).

The processing of used sand mixtures of core and green sand, as obtained normally in case of cores that disintegrate during the casting step, is extremely problematical. This used sand mixture is also called scrap sand since usually it cannot be satisfactorily regenerated and must be passed on to dumps.

In a conventional process for reclaiming such scrap sands, all organic binders are combusted, in a first phase, at about 800° C. while the active, inorganic bentonite of the green sand is converted into a passive, dead phase (dead-burning). Active bentonite is understood to mean swellable bentonite; dead-burned bentonite is understood to mean bentonite without swelling capacity. The scrap sand is subsequently aftertreated mechanically by means of impact effect in the aforedescribed way. The main drawback of this two-stage reclaiming method resides in that the dead-burned bentonite is sintered onto the quartz grain, on account of the thermal phase, whereby this bentonite shell can be removed from the quartz grain only with extreme difficulties and incompletely. Additionally, this known two-stage method can be utilized satisfactorily only if the so-called slurry material content of the scrap sand is less than 4%. Slurry materials are understood to mean the components of active bentonite (swellable bentonite), dead-burned bentonite (unswellable bentonite), coal dust or so-called anthracite components, e.g. polystyrene, resins, and fine quartz dust.

With a slurry material content of more than 5%, but especially at 10–12%, the above-described two-stage regeneration is incomplete, particularly on account of the sintered-on bentonites, so that these regenerates are reusable only with great limitations, because with given additions of binder quantities, only considerably lower strengths are attainable than with new sand. Such reclaimed scrap sands thus are practically useless for core manufacture and are primarily passed on percentagewise to green-sand mold production.

Scrap sands, but especially those with slurry material contents of about 10% and more, are therefore normally deposited on dumps. Due to the ever decreasing number of suitable dumps, and the large amount of scrap sands produced, considerable space problems evolve. Because of the transportation expenses and dump fees incurred, and also because of the only limited availability of the costly new sands, this waste of raw materials is intolerable from an economical viewpoint. Additionally, environmental problems arise due to the chemical components in the scrap sands since these components can be washed out by rain under the effects of the weather, and there is the danger of contamination of the groundwater.

The invention is based on the object of providing a process making it possible to completely reclaim foundry scrap sands with a high content of slurry material, up to the quality stage of new sand, so that the regenerate can be processed just like new sand in core manufacture.

This object has been attained according to this invention by subjecting the foundry sand, prior to thermal regeneration, to a dry precleaning during which slurry materials adhering to the sand grains, particularly inorganic binders, are removed from the sand grains, in that grain-against-grain friction is produced in the foundry sand by intermixing and circulation of the latter about a preferably horizontal axis and/or the sand grains are subjected to radial acceleration and are flung against a fixed, annular impact surface; and in that the removed slurry materials are subsequently separated from the thus-precleaned foundry sand, preferably by means of a gas-air stream.

By means of the three-stage process of this invention—mechanical precleaning, thermal treatment, mechanical final cleaning—a high-quality reclaimed quartz sand can be surprisingly obtained with unlimited usability for all existing core manufacturing methods. This reuse of reclaimed scrap sands, also those that have a high content of slurry materials, achieves the goal that the depositing of these used sands on waste dumps, as described above, and the resultant impairment of the environment are considerably reduced. With the three-stage process of this invention, an up to 75% recovery of high-quality regenerated quartz sand is made possible. Thereby a considerable saving in cost during mold production is provided since quartz sand reclaimed according to the process of this invention is more economical than new sand and, moreover, the dumping costs and freight expenses can be saved.

Due to the fact that the precleaning step is conducted in the dry state, the problems and costs of using considerable quantities of water during the course of wet regeneration, as described in the literature, are eliminated without it being possible for sintered-on clay casings to be formed in the stage of thermal regeneration.

Advantageously, in the precleaning phase, the slurry material content of the scrap sand to be reclaimed is reduced down to 2–4% by the intensive mechanical precleaning. This is advantageously accomplished by an intensive grain-against-grain friction and/or by allowing the sand grains to impinge so that contaminants adhering to the quartz sand grain are abraded, ground away and/or blasted off.

In an advantageous further development of the invention, the foundry sand, during precleaning, is dried and preheated by warm waste gas coming from thermal regeneration. Since the furnace waste gas is utilized as the gaseous stream for separating the slurry materials, the scrap sand is simultaneously dried and preheated during the precleaning phase. Thereby a lower energy consumption is ensured for conducting the process. Preferably, the foundry sand is dried in the precleaning phase according to this invention down to a water content of 0.5%.

The invention also relates to an apparatus for the thermal regeneration of foundry scrap sands, which latter contain used sand mixtures with organic and inorganic binder components, such as active and dead-burned bentonite and synthetic resins, and optionally additional slurry materials, such as coal dust, polystyrene, fine quartz dust, etc., comprising a furnace, preferably a fluidized-bed furnace, wherein the foundry sand is heated for the purpose of annealing processing, and with a cleaning device arranged downstream of the furnace for the mechanical cleaning step, which device is preferably designed as a rotary drum with an essentially horizontal axis and/or as centrifugal-action shot-blasting machine.

The invention is furthermore based on the object of further developing such an apparatus so that it is possible to regenerate in this machine, especially with the use of the process of this invention, also scrap sands with high slurry material contents, up to the quality level of new sand, so that the regenerate can be processed just as new sand also in core manufacture.

Furthermore, the apparatus of this invention for reclaiming foundry scrap sands is to be extensively prefabricated and readily transportable, and adapted to be placed in operation at the usage site in a simple way and in a short period of time.

This object has been attained according to this invention by arranging upstream of the furnace a mechanical precleaning device operating without water and being designed as a rotary drum rotatable about an essentially horizontal axis and/or as a centrifugal shot-blasting machine; preferably, baffle installations and/or grinding elements, such as balls or the like, are accommodated in the rotary drum, and the device is arranged in several portable containers, there being provided connecting flanges, adapters, coupling means and/or plug-in connections in the zone of the ceilings and/or bottoms of the congruently stackable containers in order to connect the individual units of the device with one another.

It is advantageous that the dry-operating precleaning device is an airless shot-blasting machine and/or a cylindrical drum revolving about a horizontal axis, wherein there are preferably arranged or accommodated baffle installations in the form of sheets or grinding elements, such as balls or the like. In this way, during the course of precleaning, an intensive scrap sand comminution is achieved right away, resulting in a high degree of efficiency during the thermal regeneration in the subsequently located furnace. This mechanical precleaning step, which is also possible for pure green sand, has the advantage over the devices working with an air jet that the wear and tear on the machine is lesser, and the inherent stress on the sand in the rotating drum does not lead to increased fine dust proportions or to destruction of the sand grain structure.

Due to the fact that the entire device is arranged in portable containers, transportation is not only considerably simplified—there is no need for packing and loading the individual elements of the device—but also the assembly of the device at the usage site is limited to putting down the containers and establishing the connections between the containers. Thus it is possible to create a finished assembly of the device at the manufacturer's and execute a test run; the test operation after setting up at the usage site is thus considerably simplified.

The necessary connections of the containers with one another can be constituted by adapters, instant couplings, plug-in connections and/or connecting flanges, the junction means of these being congruent to one another. By the arrangement of containers, a mobile installation has been created which can readily be transported to the site and can be installed and again disassembled with little expenditure. It has been made possible in this way for the first time to reclaim economically scrap sand created in servicing operations. Such an installation is also suitable in a special way for conducting experiments since normally the suitable conditions for a reclamation method must be investigated at the site for practical testing in a pilot process.

The provision can be made advantageously within the scope of this invention that, in the rotary drum, a conduit containing a blower terminates axially, preferably coaxially; this conduit is connected to the furnace for supplying hot waste gas from the latter. This arrangement has the advantage that considerably less energy is required for producing the gas stream through the rotary drum for performing the precleaning step than in case of devices with baffle elements.

For a further saving in energy and simplification of the structure of the apparatus of this invention, the additional provision can be made that the conduit for the feed air for the fluidized-bed furnace is connected to the rotary drum for the final cleaning step, the feed air being supplied through this rotary drum.

In order to be able to utilize the loading and transporting means customary for containers, the provision is made according to this invention that the containers have dimensions corresponding to transport containers.

The setup and placing on stream of the apparatus of this invention is considerably simplified if, as proposed according to this invention, the apparatus arranged in the containers is independent of external energy supply except for the electrical energy supply.

In order to refrain from placing excessive load on the base on which the apparatus of this invention is set up, and in order to further reduce troublesome noise, the provision can be made according to this invention to mount the units, especially the machines in the respective container, with vibration damping means.

Various possibilities exist for subdividing the individual units of the apparatus of this invention among the containers, of which normally three are provided. Thus, it is possible to arrange, in the top container, silos, a filtering installation, and a fluidized-bed furnace; in the middle container, the rotary drums for the precleaning and final cleaning, as well as a screening installation; and in the bottom container a gas installation, a compressed-air installation, a central control unit as well as a metering device with subsequently arranged mixing screw. However, an arrangement is preferred which is distinguished in that the top container houses the rotary drum for the mechanical, dry precleaning step; the middle container houses the furnace for thermal treatment; and the bottom container contains the rotary drum for the mechanical final cleaning of the foundry sand. This embodiment requires especially little energy for conveying the scrap sand to be reclaimed within the apparatus, and is preferably suited for pilot plants and/or large-scale plants.

The provision can be made in all embodiments of the invention that an elevator is located beside the stacked containers, for feeding the scrap sand to be regenerated to the feeding point arranged in the top container.

The device of this invention can be accommodated in (used) transport containers. However, it is also possible to arrange the units in container-like vessels. In this connection, it is advantageous, according to the invention, to provide that several units of those arranged in the containers, especially the vessels, the supporting construction for the casters, and the drive mechanisms for the rotary drums and/or the fluidized-bed furnace are at least partially integrated into the frame, wall, floor and/or ceiling structures of the respective containers.

Figure 2:
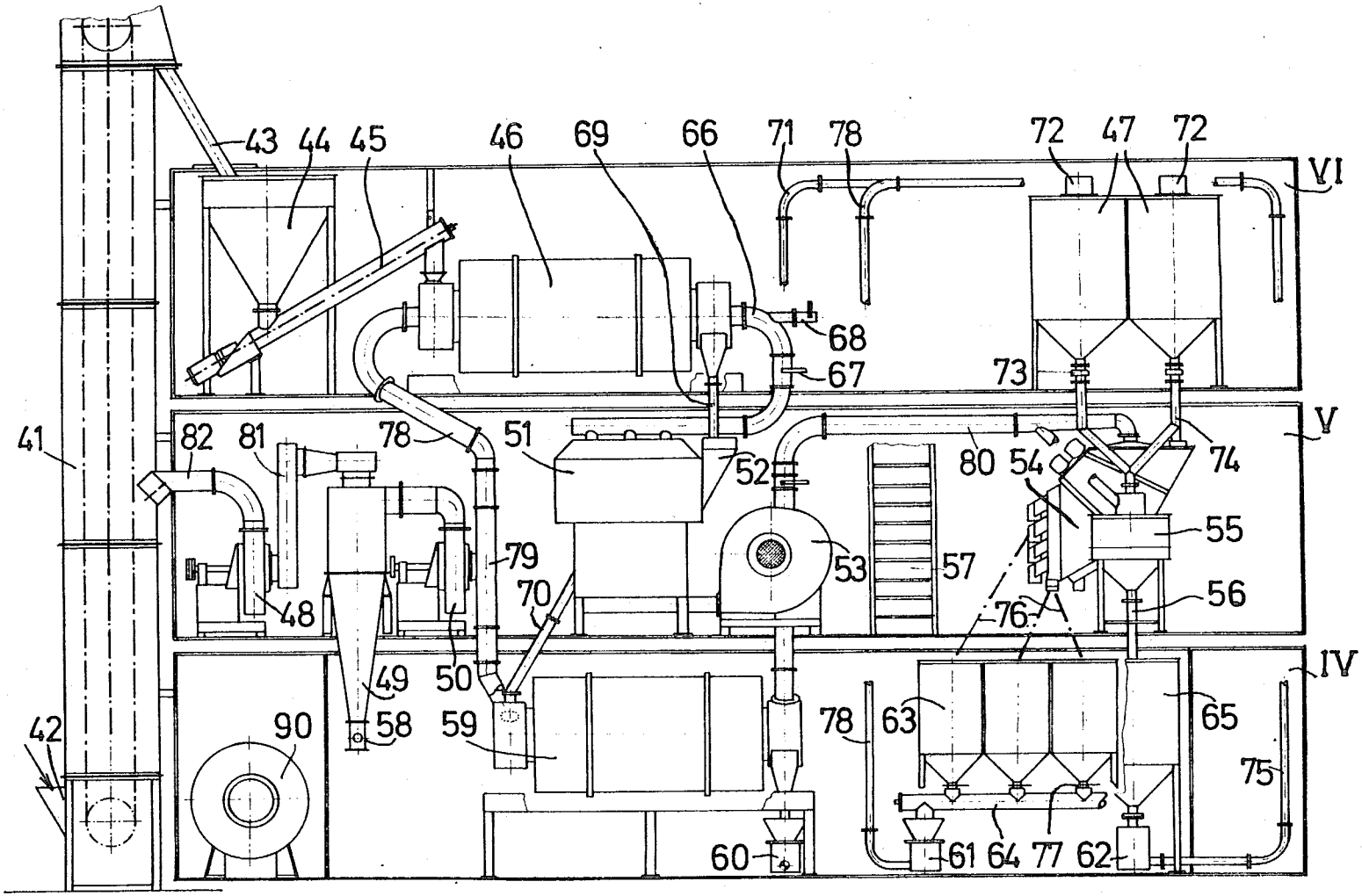
Figure 3:
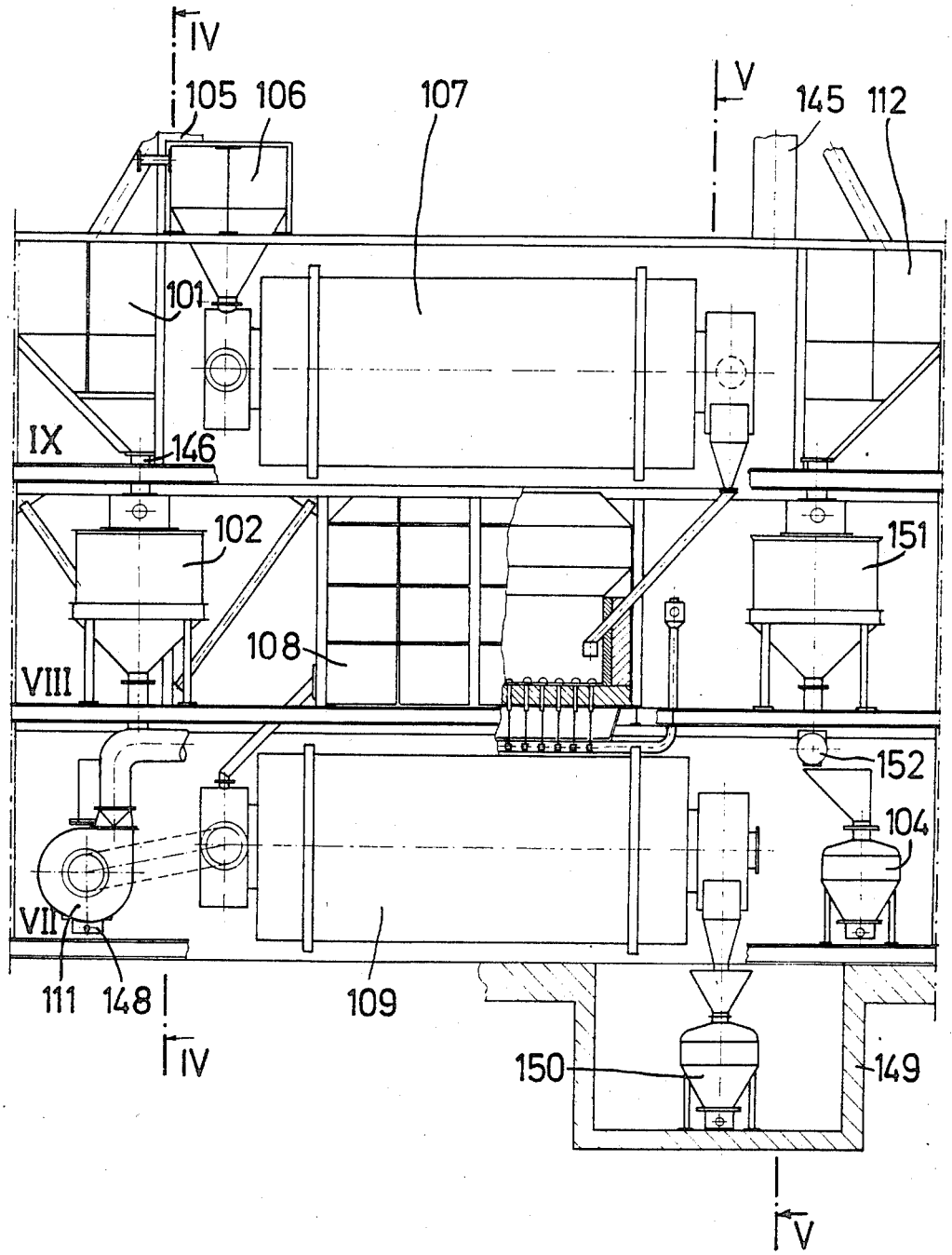
Figure 4:
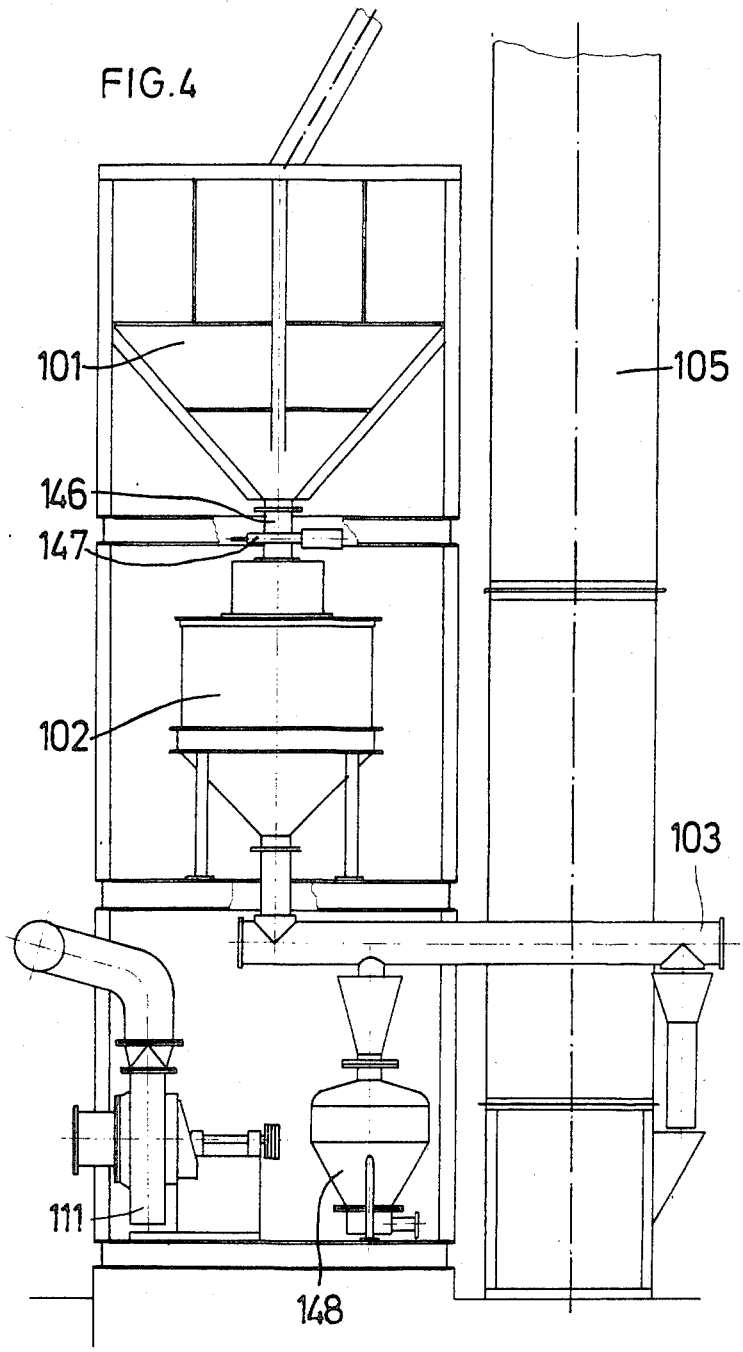
Figure 5:
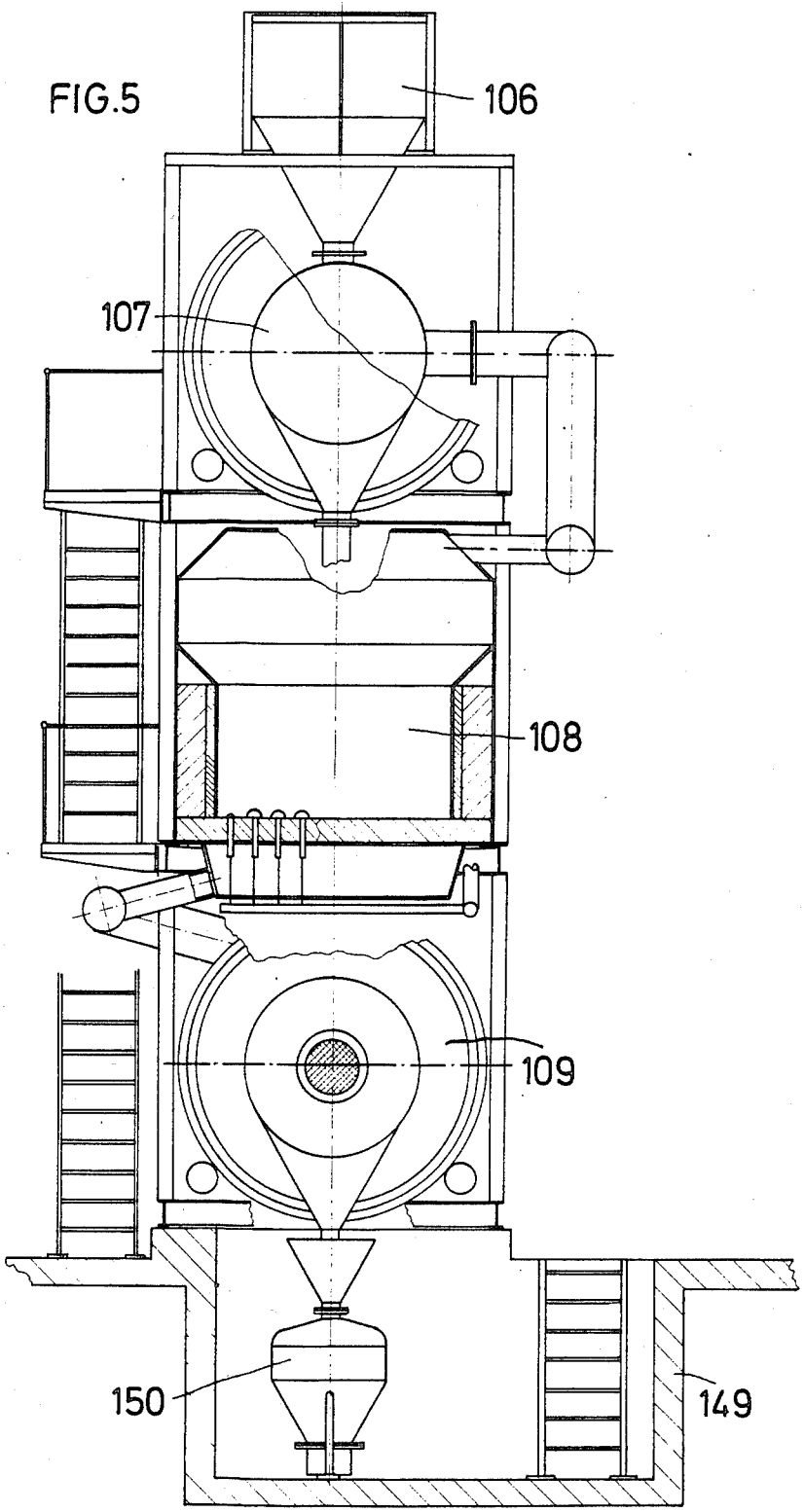

Additional features of the invention can be seen from the following description and from the drawings wherein:

FIG. 1 shows schematically the structure of a first embodiment of an apparatus for reclaiming foundry scrap sands, FIG. 2 shows a second embodiment, FIG. 3 shows a third embodiment, FIG. 4 shows a section along line IV—IV in FIG. 3, and FIG. 5 shows a section along line V—V in FIG. 3.

The apparatus according to FIG. 1 is arranged essentially in three portable containers I through III stacked congruently one on top of the other. In the connecting planes between the containers, instant connections and coupling flanges are provided to connect the units arranged in the individual containers with one another. In this arrangement, the connections are preferably opposed to each other in congruence.

The containers utilized in the embodiment have the dimensions standardized for transcontainers. They have on the outside alength of, for example, 12.19 m, a width of 2.44 m and a height of 2.59 m.

A charging silo 2 with a vibrator chute 3 arranged therebelow is housed in the top container III. Beside this unit, a filtering installation 22 is mounted therein which filters the exhaust air from the apparatus prior to discharging into the outside atmosphere. Furthermore, a fluidized-bed furnace 9 is provided in container III wherein the thermal treatment (second stage of the process of this invention) of the scrap sand is performed. Also, an intermediate storage means 12 and a discharging silo 18 are arranged in container III.

In the middle container II, in side-by-side relationship, a magnetic separator 4, two cylindrical rotary drums 5 and 10 with a respectively horizontal axis of rotation 24, as well as a mechanical screening installation 13 are provided.

Each rotary drum 5 and 10 is associated with a fan 6 and 23, respectively.

In the rotary drum 5, the scrap sand, before being charged into the fluidized-bed furnace 9 wherein the scrap sand is annealed for thermal regeneration, is pretreated for purposes of precleaning.

The rotary drum 10, arranged in the longitudinal direction behind the rotary drum 5, serves for the final cleaning of the scrap sand flowing out of the fluidized-bed furnace 9.

The lower container I houses, in side-by-side arrangement, a gas installation 20, a compressed-air installation 21, a buffer storage means 7 with a pneumatic conveyor 8 disposed therebelow, a control device 19, another pneumatic conveyor 11, and several vessels 14 for quartz sand of respectively one grain size; the sand provided in the vessels 14 is discharged via a metering unit 15 and introduced into a subsequently arranged mixing screw 16 feeding the mixture to another pneumatic conveyor 17.

The charging silo 2 in the upper container III is fed by a conveyor 1, for example an elevator, the charging funnel 25 of which is provided at the level of the bottom container I in the proximity of the ground.

From the discharge silo 18, a downcomer 26 leads away toward the bottom, terminating approximately in the region of the floor of the middle container II and capable of being connected to further conveying means in order to be able to transport the regenerate to the usage site.

Since the lower container I houses the gas installation 20 and the compressed-air installation 21, the apparatus accommodated in the three containers I, II and III requires merely an electrical energy connection to be ready for operation. After releasing the quick-action connections provided between the containers, the containers—each individually—are portable and can be transported to any desired usage points. This has the advantage, for example, that reclaiming of different scrap sands can be tested at the site under practical conditions.

In order to dampen noise, the provision can be made advantageously, besides providing noise insulation for the containers, to mount the individual units, especially the machines (vibrating chute 3, magnetic separator 4, the fans, the pneumatic conveyors, the screening installation 13, the metering unit 14,15 etc.), within the respective container in a vibration-damping fashion.

The embodiment of the apparatus illustrated in FIG. 1 operates as follows:

Foundry scrap sand, containing organic and inorganic binders, is fed, via the charging hopper 25, into the elevator 1 which latter conveys the scrap sand into the charging silo 2. By way of the vibrating chute 3, the scrap sand is continuously conveyed via the magnetic separator 4 arranged in the middle container II into the first cylindrical rotary drum 5. During conveyance on the vibrating chute 3, the scrap sand is preliminarily comminuted to grain sizes of about 5 mm.

Any residual pieces from casting that may be present in the scrap sand are separated by the magnetic separator 4 and discharged via a downcomer 27.

The first reclamation phase in the form of a dry precleaning step takes place in the first rotary drum 5. Customary baffle elements in the form of plates are provided in the rotary drum 5, determining the path of traversal of the entering scrap sand and taking care of additional comminution. In place of the baffle installations, or additionally thereto, it is possible to arrange in the rotary drum 5 grinding elements in the form of balls or the like whereby satisfactory comminution of the scrap sand is achieved.

By the rotary motion of the rotary drum 5 about its horizontal axis 24, a grain-against-grain friction is obtained in the scrap sand besides the comminuting action, since the scrap sand is intensively circulated and intermixed. Thereby, on account of the mutual friction of the quartz grains, a mechanical abrasion or grinding off of binder traces is obtained. This grain-against-grain friction is even further enhanced by the baffle installations and/or the grinding elements within the rotary drum 5.

During this mechanical and dry precleaning of the scrap sand, the latter is simultaneously dried and heated in the rotary drum 5 by means of blown-in hot air.

The waste gas discharged by the fluidized-bed furnace 9 is purified by the filtering installation 22 of dust particles etc. and fed, in the conduit 29 symbolized by arrows, to the hot-air fan 6 which blows the hot waste gases preferably coaxially to the axis of rotation 24 horizontally into the rotary drum 5. Thus, the heat content of the waste gas from the fluidized-bed furnace 9 can be exploited, and the energy requirement of the total installation can be kept at a low value The horizontally entering gas stream dries the scrap sand, for example, down to a water content of 0.5% and entrains abraded particles and suspended particles which are separated, prior to discharging of the gaseous stream, by the filter installation 22 in the upper container III.

By the precleaning of the scrap sand, its slurry material content is reduced, for example, to 2–4%; in particular, the binders in the green sand, namely the bentonites, are separated by grain-against-grain friction from the quartz grain and are discharged.

After passage through the rotary drum 5, the comminuted, precleaned and preheated scrap sand drops into the buffer storage means 7 in the bottom container I, from which it is discharged via the pneumatic conveyor 8 by way of a pipeline 28 and is introduced into the fluidized-bed furnace 9 in container III.

In the fluidized-bed furnace 9, the scrap sand is heated to a temperature of about 800° C. whereby the organic additives, such as curing agents and binders, of the core sand are combusted. Still active bentonites are dead-burned and lose their swelling ability. By means of air fed by the fan 30, the combustion residues are discharged and filtered out in the filtration installation 22. The preferably purified waste gas of the fluidized-bed furnace 9 is then conveyed via conduit 29 to the intake nipple of the hotair blower 6, associated with the rotary drum 5, in the middle container II.

Downstream of the fluidized-bed furnace 9, the sand passes via a pipeline 35 into the cylindrical rotary drum 10 in the middle container II. The rotary drum 10 corresponds in its structure to the drum 5, likewise rotates about the horizontal axis 24, and exhibits in its interior preferably likewise baffle installations and/or grinding elements, such as balls or the like.

Cooling air is fed to the rotary drum 10 horizontally and preferably coaxially to the axis of rotation 24 by way of a fan 23; this cooling air cools the sand present in the drum 10 and simultaneously discharges the combustion residue from the curing agents and binders, abraded and ground off by grain-on-grain friction. At the same time, the final cleaning and cooling of the regenerate take place in the rotary drum 10 so that there is no need for voluminous cooling units for the regenerate.

After the final cleaning step, performed in the rotary drum 10, all binder and curing agent residues, such as chemical additives have been extensively separated. The regenerate drops through a downcomer 31 into the pneumatic conveyor 11 and is conveyed through a pipeline 32 into the intermediate storage silo 12 in the top container III.

The regenerate is then classified according to grain sizes via the screening installation 13, and the grain fractions are committed to intermediate storage in vessels 14 in the bottom container I.

The undersize particles (quartz sand dust etc.) are discharged immediately via a downcomer 33 into tanks or other collecting or conveying devices, not shown.

From the vessels 14, quartz sand is discharged by way of the metering unit 15 with slides in a proportion corresponding to the desired granular composition of the regenerate, mixed in the mixing screw 16, and transported by the pneumatic conveyor 17 via a conduit 34 into the discharge silo 18 in the upper container III.

The regenerate, corresponding to the quality of new sand, can be withdrawn from the discharge silo 18 via a gravity tube 26.

The scrap sand reclaimed in this three-stage reclamation apparatus corresponds in all quality features to new sand, so that the regenerate is usable for all current core manufacturing methods. It is to be especially emphasized that the original beta quartz of the new sand has been converted into alpha quartz on account of the thermal treatment in the fluidized-bed furnace 9, which is accompanied by an increase in volume from 0.86 to 1.30%. Thus there is no danger of a volume enlargement during the casting step by conversion from beta quartz into alpha quartz, so that there cannot occur any tensions and cracks in the sand surfaces of the mold and core parts, either. In contrast thereto, when using new sand, such a conversion will take place so that the resultant stresses and cracks in the sand surfaces of the mold and core parts are mirrored in the casting surface and require increased fettling effort.

The binders separated from the quartz sand grains are separated predominantly by flowing air or gas at several locations of the apparatus, namely at the magnetic separator 4, the rotary drums 5 and 10, the fluidized-bed furnace 9, the screening installation 13, and the discharge silo 18. The waste air or waste gas of the individual units, entraining the binder particles, is conducted via a conduit network 36, indicated in dot-dash lines, to the filtering unit 22 and filtered at that point, so that extensively dust-free exhaust air leaves the apparatus.

The pilot plant shown in FIG. 2 can be utilized for conducting regeneration tests with used sands or used sand mixtures. This installation is mobile so that it can be transported into the centers of selected supply regions. With respect to the progression of operations and the process technology, this installation corresponds to a large-scale plant in accordance with this invention. Furthermore, the pilot plant illustrated in FIG. 2 is equipped with adequate safety measures from the viewpoint of process technique so that the variegated array of existing used sand mixtures can be taken care of. Finally, the pilot plant offers the possibility of optimizing the design of largescale installations by additional experiments.

The pilot plant shown in FIG. 2 is mounted in three containers having the internal dimensions of 12.020×2.350×2.390 mm. All pipelines and electrical supply and control cables are fixedly installed within the individual containers, the containers having been interconnected by means of dismountable adapters, instant couplings and plug-in means, respectively. Just as the installation shown in FIG. 1, the plant of FIG. 2 merely requires an electric power connection since a gas and compressed-air supply has been installed in the installation proper.

Except for the elevator, all components of the installation are accommodated within the containers. The reason for arranging the elevator outside of the containers resides in that assembly becomes very complicated with installation of the elevator in the interior of the containers.

In the operating condition of the installation, all of its units are readily accessible; the various levels of the installation can be reached by fixedly mounted ladders.

The elevator 41 laterally mounted to the containers IV, V and VI comprises a charging hopper 42 and at its upper end an inlet pipe 43 leading from above into the top container VI.

In the top container VI, a used sand vessel 44, a screw conveyor 45, a rotary drum 46 with a horizontal axis and four sand vessels 47 (only two are visible) are accommodated.

The middle container V houses a fan 48, a cyclone separator 49, a further fan 50, a fluidized-bed furnace 51 with laterally attached inlet pipe 52, a fan 53, a grain classifier 54 (Mogensenssizer), an airless shot-blasting machine 55 with outlet pipe 56, and an ascension ladder 57.

The bottom container IV accommodates a gas tank 90, a conveyor screw 58 connected to the lower end of the cyclone 49, a rotary drum 59, pneumatic conveyors 60, 61 and 62, storage tanks 63 for the various grain fractions connected on the outlet side to a conveyor screw 64, and a further sand vessel 65.

The pilot plant shown in FIG. 2 operates as follows:

Used sand to be reclaimed is introduced, for example manually, into the feeding hopper 42 of the elevator 41 and passes via the inlet pipe 43 into the used sand storage tank 44 having a capacity of, for example, 1,000 kg. The conveyor screw 45 conveys sand in metered amounts into the rotary drum 46 wherein sand clumps are comminuted, the sand is dried and precleaned, as well as preheated.

The rotary drum 46 is subdivided into three sections by installations arranged perpendicularly to the drum axis. In the first section, the sand lumps are comminuted primarily, enhanced by the use of rod-shaped grinding elements. This section is separated by a perforated plate from the subsequent section of the rotary drum 46 so that only sand that is already free-flowing can pass into the subsequent segment of the drum. In the middle section of the drum 46, the used sand to be reclaimed (scrap sand) is precleaned by grain-on-grain friction, enhanced by a variable proportion of grinding elements. The third section of the rotary drum 46 operates without grinding elements and serves primarily for removing dust from the sand.

The sand contained in the rotary drum 46 is dried, freed of dust and preheated by countercurrently conducted exhaust air from the fluidized-bed furnace 51. For this purpose, the fluidized-bed furnace 51 is connected via a conduit 66 with throttle valve 67 .

The sand, having a slurry material content of 3–4%, freed by cyclone-classifying in the rotary drum 46 from a large portion of the abraded fines and being preheated to a temperature of about 300° C., is introduced via a pipe 69 at 52 into the fluidized-bed furnace 51 wherein a sand temperature is maintained of 700°–800° C. In the fluidized-bed furnace 51, organic binder residues are completely combusted and the sand is then fed via an outlet pipe 70 to the rotary drum 59 arranged in the bottom container IV.

The rotary drum 59 has the same structure as the rotary drum 46 in the top container VI and effects cooling of the sand to about 120° C., cleaning out of combustion residue and of the deactivated bentonite, as well as dust removal from the sand.

The rotary drum 46 as well as the rotary drum 59 are designed so that the sand, with an output of 0.50 t/h, has a residence time of about 60 min.

A large portion of the required reclamation work has already been performed by the vertical line described thus far. The sand exiting from the rotary drum 59 has been adequately regenerated already for many cases.

However, the installation shown in FIG. 2 permits additional final cleaning of the sand discharged from the rotary drum 59.

For this purpose, the sand exiting from the rotary drum 59 is conducted by the pneumatic conveyor 60 via a conduit 71 into the sand tank 47 provided with four chambers. By selective operation of the pneumatic snap valves 72 arranged at the vessel 47, a selection can be made of the chamber of tank 47 to be charged with the sand fed via conduit 71. It is thereby possible to fill one of the chambers of vessel 47 whereas sand is fed to the centrifugal-wheel cleaner 55 from another chamber via one of the slide valves 73 and the Y-pipe 74. The centifugal-wheel cleaner 55 is designed so that the cleaning step can be repeated four times during the filling period for one of the chambers of tank 47. The sand passes via the tank 65 and the pneumatic conveyor 62 and a sand-conveyor conduit 75 into another one of the chambers of tank 47 or, after conclusion of the final cleaning step, into a third one of the chambers of tank 47.

The finally cleaned sand is now in the third chamber of tank 47; the previously filled chamber is now empty; and the first chamber is bring filled with sand.

The sand finally cleaned by the centrifugal-wheel cleaner 55 and present in one of the chambers of tank 47 is conducted via a conduit into the classifier 54. The regenerate is divided into the three most important grain fractions, the dividing lines being selected so that all customary grain distributions can be produced. Through downcomers 76, indicated in dot-dash lines, the individual grain fractions enter the tripartite tank 63. The desired quantities of grain fractions are withdrawn from vessel 63 by way of adjustable discharge metering slide valves 77 and with intermixing are conveyed through the screw conveyor 64, the pneumatic converyor 61 and a conduit 78 into the fourth chamber of the tank 47.

By way of an outlet pipe, not shown, the regenerate having the desired particle size distribution can be removed from the tank 47.

The fluidizing air required for the fluidized-bed furnace 51 is supplied by the fan 53 which takes in fresh air. The waste gas, heated up to 700°–800° C. in the fluidized-bed furnace 51, is fed via the exhaust gas conduit 66 to the rotary drum 46 and from the latter taken in via a conduit 78 into a collecting manifold 79.

A second air stream coming from the shotblasting cleaner 55 and from the classifier 54, respectively, is supplied as cooling air to the rotary drum 59 via a conduit 80 and finally passes likewise into the manifold 79.

From the manifold 79, the waste air passes by way of the fan 50 into the cyclone separator 49 and further via a conduit 81 to the pure-gas fan 48 and finally via a conduit 82 to the outside.

The installation is supplied with gas by way of a tank 90 for liquid gas, having a capacity of, for example, 900 kg; this tank is equipped with all required control and safety features. One filling of the tank 90 suffices for an operating period of about 80 hours.

Furthermore, a compressor (not shown) is provided in the bottom container IV, for example on the right-hand side beside the tank 65; this compressor yields conveying air for the pneumatic conveyors 60, 61 and 62 and furthermore the regulating air for the pneumatic slides 73 and 77.

The proportion of dust separated in cyclone 49 (if desired, two or more cyclones can also be provided) is conveyed via the conveyor screw 58 to a rotary vane feeder and discharged therethrough from time to time.

The embodiment of the arrangement of this invention illustrated in FIGS. 3–5 is likewise accommodated in three superimposed containers VII, VIII and IX and is designed for a throughput of 7.5 t/h. In this embodiment, the silos for the scrap sand, the regenerate and the classifying unit are arranged outside of the containers, which offers the advantage that the capacity of the installation can be enlarged, for example, to 15 t/h by setting up a second reclamation unit (containers VII, VIII and IX).

In the construction of the embodiment illustrated in FIGS. 3–5, the basic aspect is not the mounting of individual units in containers, as in the embodiments shown in FIGS. 1 and 2, but rather the designing of containers and units as a structural whole. Thus, for example, the sand tanks 101 and 112 are fashioned as a wall structure, using the frame construction of container IX. The supporting structure for receiving the casters and the drive mechanisms for the two rotary drums 107 and 109 are simultaneously the floor construction for the containers VII and IX, respectively.

The fluidized-bed furnace 108 is integrated into container VIII and likewise lacks its own supporting and wall structures.

The three superimposed containers VII, VIII and IX represent a complete reclamation unit; only the two elevators 105 and 145, as well as the pneumatic conveyor 150 are arranged externally.

The installation shown in FIGS. 3–5 operates as follows:

From a conveyor, not shown, which is pneumatic, for example, the scrap sand to be reclaimed is conveyed into the sand tank 101 in the upper container IX. By gravity, the sand passes into a centrifugal-wheel cleaner 102 disposed therebelow and, from the latter, via a pipe 103 exposed to vibrations into the feeding hopper of the elevator 105. Between the and tank 101 and the shotblasting cleaning unit 102, in the conduit 146 connecting these units, a slide valve 147 is provided which can be operated pneumatically.

An adjustable partial quantity (for example 20–30%) of the sand conveyed through conduit 103 is transported by a pneumatic conveyor 148 arranged in the bottom container VII into a sand tank 106 on the topside of the top container IX, whereas the elevator 105 returns the remainder, i.e. for example 70–80%, of the sand stream into the sand tank 101. This arrangement achieves the result that the sand passes three to five times through the centrifugal-wheel cleaner 102 before it passes for further treatment into the rotary drum 107. The rotary drum and its function correspond to the rotary drum 46 of the embodiment shown in FIG. 2.

Downstream of the rotary drum 107, the precleaned scrap sand passes through a fluidized-bed furnace 108 to burn off any organic binder residues, and then for final cleaning through a rotary drum 109.

Another pneumatic conveyor 150 arranged after the rotary drum 109 and below the bottom container VII in the base 149 transports the thus-reclaimed sand into the sand tank 112 in the top container IX. From this sand vessel 112, the sand passes into a second centrifugal-wheel cleaner 151 wherein a final cleaning step is conducted. From the centrifugal-wheel cleaner 151, the finally reclaimed sand is transported via a vibrating pipe 152 into a pneumatic conveyor 104 which latter conveys the regenerate, for example, into a mixture silo set up beside the containers VII, VIII, IX.

Following the mixture silo, or also directly following the pneumatic conveyor 104, a device for classification and mixing of the individual grain fractions in the desired proportion can be arranged; this device can have a structure similar to that of the corresponding device of the installation shown in FIG. 2.

In the bottom container VII, a fan 111 is furthermore illustrated for the fluidized-bed furnace 108. The other air-conducting conduits are only partially illustrated in FIGS. 3-5 for the sake of clarity. The air conductance and/or waste gas conductance in the installation shown in FIG. 5 corresponds, in principle, to that of FIG. 2.

Using the process of this invention and/or utilizing the regenerating installation according to this invention, it is possible to extensively remove, from the used sands, binders and curing agent residues, quartz dust (undersize particles) and other deleterious substances. This is also accomplished in case of scrap sands composed of green sand and chemically bonded core sands.

In this connection, the thus-reclaimed sand corresponds practically to new sand with regard to the most important quality features, such as grain configuration, grain distribution, average grain size, and degree of uniformity, and there is the possibility of adapting these quality features to the respective requirements by screening and classifying.

The regenerate obtained according to this invention is of such a character that, when utilized in core manufacture with the same additions of binders, the same strengths are attained as with new sand. It is taken into account here that regenerate yields of 75% of the used sand quantity are obtained, so that, therefore, a regenerate-new sand mxiture of 75:25 can be compared to pure new sand.

Since the scrap sands to be reclaimed are composed predominantly of green sand and chemically bonded core sands, the following determining variables are governing for determination of the degree of regeneration:

| | |
|---|---|
| Bentonite-bonded sand | Slurry material content |
| Chemically bonded sand | Annealing loss |

In the overview below, the changes of these determining variables by the regeneration are illustrated and compared with those of a new sand.

| | Scrap Sand | Regenerate mtm | New Sand ZE 82 N |
|---|---|---|---|
| Slurry Material | 11.00 | 0.28 | 0.40 |

-continued

| | Scrap Sand | Regenerate mtm | New Sand ZE 82 N |
|---|---|---|---|
| Content Annealing Loss | 3.78 | 0.00 | 0.30 |

It is of considerable significance for the process of this invention that a regenerate is obtained therein, when used with the same binder quantities, there is no appreciable drop in strength (bending strength in $N/cm^2$) of the cores. The strengths were tested for the binders furan resin, Hot Box and Cold Box (U.S. Pat. No.3 409,579), and it was found that a mixture of regenerate/new sand of 75:25, under otherwise identical conditions, yields practically the same results as pure new-sand mixtures The governing characteristics of the regenerate obtained according to this invention, as well as the practical tests have shown that the entire reclaimed product (75% of the amount of scrap sand) can be processed without problems in core making. In this connection, it should furthermore be pointed out that the tests were conducted with those types of binders that are particularly sensitive with respect to sand quality.

The most important characteristics are set out below:

| | Governing Bending Strengths in $N/cm^2$ | | |
|---|---|---|---|
| | Furan Resin, Curing 24 h | Hot Box | Cold Box, Processing 30 min |
| New Sand F 32 | 388 | 750 | 335 |
| 75% Reg. ptp 25% NS F 32* | 369 | 700 | 323 |

*New sand from the sandpit in Frechen (Federal Republic of Germany)

The overview below is a compilation of the most important deleterious materials to be removed during sand reclaiming. At the same time the degradation obtained in the individual regenerating stages is indicated. In this overview, the stage "Mechanical I" corresponds to the treatment in the rotary drums 5, 46 and 107, respectively; the process stage "Thermal" to the treatment in the fluidized-bed furnace 9, 51 and 108, respectively, and the process stage "Mechanical II" to the treatment in rotary drums 10, 59 and 109, respectively.

| DEGRADATION OF DELETERIOUS SUBSTANCES IN THE INDIVIDUAL PROCESS STAGES | Chemical Classification | PROCESS STAGES (m) I Mechanical | Thermal (mt) | (mtm) II Mechanical |
|---|---|---|---|---|
| Chemical Binders (Furan, Cold Box, Hot Box) | Organic | Partially by Mechanical Abrasion | Completely by Combustion | Cleaning off the Residues |
| SLURRY MATERIALS | | | | |
| Dead-burned Bentonite | Inorganic | Partially | 0 | Elimination to Final Value |
| Active Bentonite (Binding Strength Preserved) | Inorganic | Minor | Conversion Dead-Burned Bentonite | Elimination to Final Value |
| Carbon Materials | Organic | Partially | Completely by Combustion | Cleaning off the Residues |
| Quartz Dust (Undersize Grain) | Inorganic | Partially | 0 | Removal by Cyclone Action |
| Other Slurry | Inorganic | Partially | Insofar as | Elimination |

-continued

| DEGRADATION OF DELETERIOUS SUBSTANCES IN THE INDIVIDUAL PROCESS STAGES | Chemical Classification | PROCESS STAGES (m) I Mechanical | Thermal (mt) | (mtm) II Mechanical |
|---|---|---|---|---|
| Materials | Organic | | Organic, by Combustion | to Final Value |

In the described embodiments, the dry precleaning step is performed in a rotary drum (FIG. 1 and FIG. 2) or in a shotblasting cleaner and a rotary drum (FIGS. 3–5).

However, it is also possible (depending on the peculiarity of the foundry scrap sand) to conduct the dry precleaning solely in a shotblasting cleaner. In this case, the rotary drum for precleaning is dispensible. In order to exploit the heat content of the waste gases from the fluidized-bed furnace for preheating and drying of the scrap sand, a fluidized-bed preheater can be additionally provided besides the shotblasting cleaner.

These three possibilities for precleaning (rotary drum, shotblasting cleaner with subsequently arranged rotary drum and shotblasting cleaner optionally with fluidized-bed preheater) are also usable for the final cleaning step; in case the final cleaning is performed with a shotblasting cleaner alone, the feed air for the fluidized-bed furnace wherein thermal regeneration takes place can be preheated by a fluidized bed cooler which cools the sand.

Finally, it is furthermore possible to effect precleaning and final cleaning in an installation with different devices or apparatus combinations (rotary drum and/or shot-blasting cleaner, optionally with fluidized-bed preheater and/or cooler).

A shotblasting cleaner usable within the scope of the invention comprises a centrifugal wheel, rotating about a vertical axis, with radial strips, imparting to the sand, fed from above via a pipe coaxial to the axis of rotation, a radial acceleration. A fixed impact ring with a V-shaped indented impact surface is arranged coaxially to the centrifugal wheel, the sand, radially accelerated by the centrifugal wheel, impinging on the lower half of the impact ring, being deflected from there upwardly toward the upper ring half, and being deflected essentially radially inwardly from this upper ring half, whereupon the sand, while intersecting the sand stream moving toward the impact ring, drops downwardly out of the shotblasting cleaner. Cleaning of the sand takes place in this shotblasting cleaner by impingement and frictional engagement of the sand grains upon and with one another, such friction taking place especially in the zone of intersection with the sand stream.

I claim:

1. A process for reclaiming used foundry sand, comprising the steps of:

subjecting comminuted, used foundry sand containing organic and inorganic binders to a mechanical abrading treatment in the absence of added moisture, said abrading treatment being effected at a temperature of not more than about 300° C. and with sufficient force to separate sand particles contained in said used sand from said inorganic binders coated thereon;

heating the thus-abraded used sand at a temperature sufficient to ensure combustion of said organic binders; and subjecting the thus-treated used sand to a further mechanical treatment for removing binder residues adhered to said sand particles from said sand particles.

2. Process according to claim 1, wherein said mechanical abrading treatment comprises intermixing and circulating said used foundry sand about an axis, thereby to promote grain-against-grain friction of said sand particles.

3. Process according to claim 2, wherein said mechanical abrading treatment comprises accelerating said sand particles radially outwardly relative to said axis, and propelling said particles against a fixed impact surfaces.

4. Process according to claim 1, wherein said mechanical abrading treatment comprises reducing said organic and inorganic binders contained in said used foundry sand to a content of 2–4% by weight.

5. Process according to claim 1, and using warm waste gas generated by said combustion to dry and preheat said used foundry sand during said mechanical abrading treatment.

6. Process according to claim 5, wherein said used foundry sand is dried during said mechanical abrading treatment to a water content of 0.5%

7. Apparatus for reclaiming used foundry sand, comprising:

means for subjecting comminuted, used foundry sand containing organic and inorganic binders to a mechanical abrading treatment in the absence of added moisture, at a temperature of not more than about 300° C. and with sufficient force to separate sand particles contained in said used sand from said inorganic binders coated theron;

means for heating the thus-abraded used sand at a temperature sufficient to ensure combustion of said organic binders; and means for subjecting the thus-treated used sand to a further mechanical treatment for removing binder residues adhered to said sand particles from said sand particles.

* * * * *